United States Patent [19]

Borst et al.

[11] Patent Number: 4,552,101

[45] Date of Patent: Nov. 12, 1985

[54] FLUID PRESSURE ACTUATED MOTOR WITH PNEUMATICALLY-COUPLED PISTONS

[75] Inventors: Gaylord M. Borst; Frank J. Walsworth, both of Waukegan, Ill.

[73] Assignee: Outboard Marine Corporation, Waukegan, Ill.

[21] Appl. No.: 464,197

[22] Filed: Feb. 7, 1983

[51] Int. Cl.[4] ..... F02B 33/02

[52] U.S. Cl. ..... 123/73 AD; 123/DIG. 5; 417/339; 417/395; 92/63

[58] Field of Search ..... 417/393, 339, 342, 347, 417/395; 123/73 AD, DIG. 5; 92/48, 146, 63

[56] References Cited

U.S. PATENT DOCUMENTS

| | | | |
|---|---|---|---|
| 1,995,611 | 3/1935 | Hapgood | 417/395 |
| 3,630,642 | 12/1971 | Osterman | 417/395 |
| 3,653,784 | 4/1972 | Leiterman et al. | 123/73 AD |
| 3,765,802 | 10/1973 | Leiterman et al. | 417/395 |
| 3,913,551 | 10/1975 | Shaver | 123/73 AD |
| 4,381,741 | 5/1983 | Walsworth | 123/73 AD |

FOREIGN PATENT DOCUMENTS

| | | |
|---|---|---|
| 1064823 | 4/1967 | United Kingdom . |
| 1131844 | 10/1968 | United Kingdom . |
| 1319718 | 6/1973 | United Kingdom . |
| 1481521 | 8/1977 | United Kingdom . |
| 1550039 | 8/1979 | United Kingdom . |

*Primary Examiner*—Leonard E. Smith

*Attorney, Agent, or Firm*—Michael, Best & Friedrich

[57] ABSTRACT

A fluid pressure actuated motor assembly comprising a first fluid pressure actuated motor including a first reciprocating piston driven by a pressure differential across the first reciprocating piston, and a second fluid pressure actuated motor in communication with the first fluid pressure actuated motor and including a second reciprocating piston driven by the pressure differential across the first reciprocating piston.

9 Claims, 1 Drawing Figure

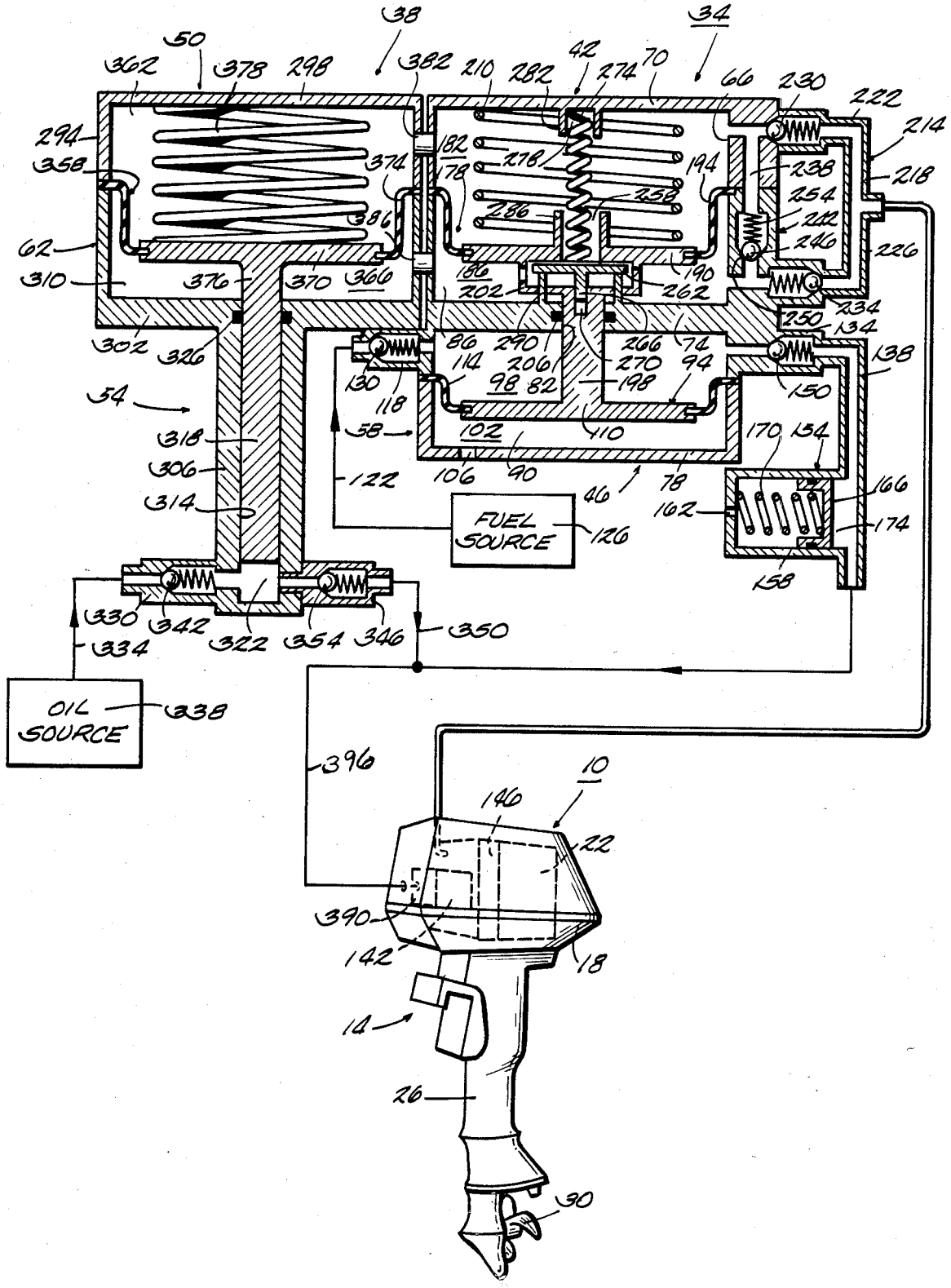
FUEL SOURCE
OIL SOURCE

FLUID PRESSURE ACTUATED MOTOR WITH PNEUMATICALLY-COUPLED PISTONS

BACKGROUND OF THE INVENTION

The invention relates generally to fluid pressure actuated motors and, more particularly, to combined fuel and oil pump arrangements.

The invention also relates generally to internal combustion engines and, more particularly, to two-stroke internal combustion engines and to means for supplying the engines with a fuel-oil mixture.

Attention is directed to the Walsworth U.S. Pat. No. 4,473,340 entitled "Combined Fluid Pressure Actuated Fuel and Oil Pump" filed Oct. 23, 1981, which is incorporated herein by reference.

SUMMARY OF THE INVENTION

The invention provides a fluid pressure actuated motor assembly comprising a first fluid pressure actuated motor including a first reciprocating piston driven through a first stroke length by a pressure differential across the first reciprocating piston, and a second fluid pressure actuated motor in communication with the first fluid pressure actuated motor and including a second reciprocating piston driven through a second stroke length by the pressure differential across the first reciprocating piston, and means for varying the second stroke length relative to the first stroke length in response to variation in the magnitude of the pressure differential across the first piston.

The invention also provides an internal combustion engine including means for generating alternating high and low pressure conditions, a first fluid pressure actuated motor including a first reciprocating piston driven through a first stroke length by a pressure differential across the first reciprocating piston in response to respective application to opposite sides of the first piston of the alternating high and low pressure conditions, and a second fluid pressure actuated motor in communication with the first fluid pressure actuated motor and including a second reciprocating piston driven through a second stroke length by the pressure differential across the first reciprocating piston, and means for varying the second stroke length relative to the first stroke length in response to variation in the magnitude of the pressure differential across the first piston.

The invention also provides a marine propulsion device comprising an internal combustion engine including means for generating alternating high and low pressure conditions, a first fluid pressure actuated motor including a first reciprocating piston driven through a first stroke length by a pressure differential across the first reciprocating piston in response to respective application to opposite sides of said first piston of the alternating high and low pressure conditions, and a second fluid pressure actuated motor in communication with the first fluid pressure actuated motor and including a second reciprocating piston driven through a second stroke length by the pressure differential across the first reciprocating piston, and means for varying the second stroke length relative to the first stroke length in response to variation in the magnitude of the pressure differential across the first piston.

The invention also provides a fluid pressure actuated motor comprising a first housing, a first piston movable reciprocally in the first housing and dividing the first housing into a first relatively low pressure chamber and a first relatively high pressure chamber. The motor also includes first means for biasing the first piston so as to displace the first piston in a direction minimizing the volume of the first high pressure chamber and maximizing the volume of the first low pressure chamber. The motor also includes means for creating a fluid pressure differential between the first high and first low pressure chambers so as to displace the first piston in the direction minimizing the volume of the first low pressure chamber and maximizing the volume of the first high pressure chamber and means for reducing the pressure differential between the first high and first low pressure chambers so as to thereby permit displacement of the first piston by the first biasing means in the direction minimizing the volume of the first high pressure chamber and maximizing the volume of the first low pressure chamber. The motor also includes a second housing and a second piston movable reciprocally in the second housing and dividing the second housing into a second relatively low pressure chamber and a second relatively high pressure chamber. The second relatively low pressure chamber is in communication with the first low pressure chamber and the second relatively high pressure chamber is in communication with the first high pressure chamber. The motor also includes second means for biasing the second piston so as to displace the second piston in the direction minimizing the volume of the second high pressure chamber and maximizing the volume of the second low pressure chamber.

In one embodiment, the first housing and second housing are integrally connected. In another embodiment, the first housing and the second housing are detached and a first conduit connects the first low pressure chamber to the second low pressure chamber and a second conduit connects the first high pressure chamber to the second high pressure chamber.

The fluid pressure actuated motor can be used in conjunction with means for pumping fuel in response to reciprocal movement of the first piston and means for pumping oil in response to reciprocal movement of the second piston.

One of the principal features of the invention is to provide a motor which includes a slave motor driven by a master fluid pressure actuated motor.

Another of the principal features of the invention is to provide a slave motor which will reciprocate at a frequency identical to that of a master motor but with an amplitude which varies depending on the magnitude of the pressure differential supplied to the master motor.

Another of the principal features of the invention is to provide a slave motor in combination with a master motor, with the output of the slave motor depending upon the magnitude of the fluid pressure differential which drives the master motor. When used in conjunction with fuel pumping means connected to the master motor and oil pumping means connected to the slave motor, the motor can provide a throttle-dependent, variable ratio fuel-oil mixture for a two-stroke internal combustion engine.

Other features and advantages of the embodiments of the invention will become known by reference to the following general description, claims, and appended drawings.

BRIEF DESCRIPTION OF THE DRAWINGS

FIG. 1 is a schematic view of a combined fuel and oil pump including a fluid pressure actuated motor including various features of the invention.

Before explaining one embodiment of the invention in detail, it is to be understood that the invention is not limited in its application to the details of construction or the arrangement of the components set forth in the following description or illustrated in the drawings. The invention is capable of other embodiments and being practiced and carried out in various ways. Also, it is to be understood that the phraseology and terminology employed herein is for the purpose of description and should not be regarded as limiting.

DESCRIPTION OF THE PREFERRED EMBODIMENT

Shown in the drawings is a marine propulsion device 10 in the form of an outboard motor which includes a propulsion unit 14 including a power head 18 incorporating a two-stroke internal combustion engine 22. The propulsion unit 14 also includes a lower unit 26 which is secured to the power head 18 and which rotatably supports a propeller 30 driven by the internal combustion engine 22.

Connected to the internal combustion engine 22 is a combined fuel and oil pump 34 including a fluid pressure motor assembly 38 actuated by a source of alternating relatively high and low pressures. Although the motor assembly 38 is described in connection with a marine propulsion device 10, a motor assembly embodying various features of the invention can be used in other applications, such as in a lawn mower.

More particularly, the fluid pressure actuated motor assembly 38 includes a master motor 42 and a slave motor 50, with the master motor 42 driving fuel pumping means 46 and the slave motor 50 driving oil pumping means 54. Although other constructions can be employed, in this embodiment the master motor 42 and fuel pumping means 46 are enclosed in a first housing 58 and the slave motor 50 and oil pumping means 54 are enclosed in a second housing 62.

More particularly, the first housing 58 includes a peripheral wall 66, together with a top wall 70, an intermediate wall or partition 74, and a bottom wall 78. The intermediate wall 74 includes a central bore or port 82 and divides the first housing 58 into an upper compartment 86 and a lower compartment 90.

The fuel pumping means 46 includes a movable wall or member 94 which is located in the lower compartment 90 and which divides the lower compartment into a variable volume fuel pumping chamber 98 located between the intermediate wall 74 and the movable wall 94 and a lower or vent chamber 102 which communicates with the atmosphere through a port 106 in the bottom wall 78. The movable wall 94 includes a fuel pumping piston 110 which, at its periphery, has attached thereto a flexible membrane or diaphragm 114 which, in turn, is attached to the peripheral wall 66 of the first housing 58.

The fuel pumping means 46 also includes, in the peripheral wall 66, a valved fuel inlet 118 which is adapted to communicate through a conduit 122 with a suitable source 126 of fuel and which includes one-way check valve means 130 affording inflow of fuel in response to an increase in the volume of the fuel pumping chamber 98 and which prevents outflow of fuel from the fuel pumping chamber 98.

The fuel pumping means 46 also includes, in the peripheral wall 66, a valved fuel outlet 134 which is adapted to communicate through a conduit 138 with a device, such as a carburetor 142, for feeding a fuel-oil mixture to a crankcase 146 of the two-stroke engine 22. The valve outlet 134 includes a one-way check valve 150 which affords outflow of fuel in response to a decrease in the volume of the fuel pumping chamber 98 and which prevents inflow of fuel.

Preferably, the conduit 138 includes an accumulator 154 in the form of a cylinder 158 which, at one end, communicates with the conduit 138 and which, at the other or outer end, is vented to the atmosphere by a port 162. Located in the cylinder 158 is a piston 166 which is suitably biased by a spring 170 in the direction toward the conduit 138 so as to provide a variable volume accumulating chamber 174 which serves to reduce or eliminate pulsing of fuel at the discharge end of the conduit 138.

The fluid pressure actuated master motor 42 is located generally in the upper compartment 86 and is connected to the fuel pumping piston 110 so as to effect common reciprocation thereof through a given stroke or distance. More particularly, the fluid pressure actuated master motor 42 is responsive to a source of alternating relatively high and low pressures for effecting reciprocation of the fuel pumping piston 110. Still more particularly, the fluid pressure actuated master motor 42 includes a first movable wall 178 which divides the upper compartment 86 into a first upper, relatively low pressure variable volume chamber 182 and a first lower, relatively high pressure variable volume chamber 186. The first movable wall 178 includes a central or first motor piston 190 which, at its outer periphery, is connected to a flexible membrane or diaphragm 194 which, at its outer periphery, is secured to the peripheral housing wall 66 so as to divide the upper compartment 86 into the before-mentioned first relatively low and high pressure chambers 182 and 186, respectively.

The first motor piston 190 is also preferably integrally connected with the fuel pumping piston 110 for common movement. In this last regard, the combined first motor piston 190 and fuel pumping piston 110, includes a central portion 198 which extends from the fuel pumping piston 110 toward the first motor piston 190 and through the central bore or port 82 in the intermediate wall 74, and a connecting portion which forms an open valve cage 202 and which connects the central portion 198 to the first motor piston 190. A suitable seal 206 is provided between the intermediate wall 74 and the central portion 198.

The master motor 42 further includes first means biasing the first movable wall 178 so as to displace the first movable wall 178 in the direction minimizing the volume of the first high pressure chamber 186 and maximizing the volume of the first low pressure chamber 182. In the illustrated construction, such first means comprises a helical spring 210 which, at one end, bears against the upper or top housing wall 70 and which, at the other end, bears against the first motor piston 190.

The master motor 42 also includes means 214 for creating a pressure differential between the first low and high pressure chambers 182 and 186, respectively, or across the first motor piston 190, so as to displace the first movable wall 178 in the direction minimizing the volume of the first low pressure chamber 182 and maximizing the volume of the first high pressure chamber 186. While various arrangements can be employed, in the illustrated construction, such means includes means adapted for connection to a source of alternating relatively high and low pressures and including means permitting flow from the first low pressure chamber 182 and preventing flow to the first low pressure chamber 182, and means permitting flow to the first high pressure chamber 186 and preventing flow from the first high pressure chamber 186.

Preferably, the source of alternating relatively high and low pressures is the crankcase 146 of the two-stroke engine 22. However, other sources of relatively high and low pressures can be employed. In addition, relatively high and low pressures can refer to two positive pressures above atmospheric pressure, to two negative pressures below atmospheric pressure, or to one positive pressure above atmospheric pressure and one negative pressure below atmospheric pressure.

Still more specifically, the means for creating the pressure differential between the first relatively low and high pressure chambers 182 and 186, respectively, comprises a conduit system 214 including a main conduit 218 adapted to be connected to the source of alternating high and low pressures, such as the crankcase 146 of the two-stroke engine 22, together with a first or low pressure branch conduit 222 which communicates between the first low pressure chamber 182 and the main conduit 218 and a second or high pressure branch conduit 226 which communicates between the first high pressure chamber 186 and the main conduit 218.

Included in the low pressure branch conduit 222 is a one-way check valve 230 which permits flow from the first low pressure chamber 182 and prevents flow to the first low pressure chamber 182. Located in the high pressure branch conduit 226 is a one way check valve 234 which permits flow to the first high pressure chamber 186 and which prevents flow from the first high pressure chamber 186.

Accordingly, alternating pressure pulses of relatively high and low pressures present in the main conduit 218 will cause the existence of a relatively high pressure in the first high pressure chamber 186 and a relatively low pressure in the first low pressure chamber 182, which pressure differential is of sufficient magnitude, as compared to the biasing action of the first movable wall biasing spring 210, so that the pressure differential is effective to cause movement of the first movable wall 178 from a position in which the first high pressure chamber 186 is at a minimum volume to a position in which the first low pressure chamber 182 is at a minimum volume.

Preferably, the conduit system 214 also includes means for relieving an excessive pressure differential. In this regard, the conduit system 214 includes a bypass conduit 238 which communicates with the low and high pressure branch conduits 222 and 226, respectively, so as to be in direct communication with the first low and high pressure chambers 182 and 186, respectively. The bypass conduit 238 includes a one-way pressure regulating valve 242 including a ball member 246 which is engaged with a seat 250 and held in such engagement by a spring 254 designed to release the ball member 246 from engagement with the seat 250 in the event of an excessive pressure differential.

The master motor 42 also includes means responsive to piston movement minimizing the volume of the first low pressure chamber 182 for establishing communication between the first low and high pressure chambers 182 and 186, respectively, so as thereby to reduce or minimize the pressure differential between the first low and high pressure chambers 182 and 186, respectively, and thereby permit displacement of the first movable wall 178 by the biasing spring 210 in the direction minimizing the volume of the first high pressure chamber 186 and maximizing the volume of the first low pressure chamber 182. While such means can be provided, at least in part, by a conduit (not shown) bypassing the first motor piston 190, in the illustrated construction, such means comprises a central port 258 in the first motor piston 190, together with a valve member 262 which is located in the open cage 202 of the combined first motor piston 190 and fuel pumping piston 110 and which is movable between a closed and an open position. Preferably, the valve member 262 includes a downwardly extending stem 266 which is received in a mating recess or axial bore 270 in the central portion 198 of the combined piston so as to guide movement of the valve member 262 between its open and closed positions.

In addition, the means for effecting communication between the first low and high pressure chambers 182 and 186, respectively, includes a helical valve member biasing spring 274 which urges the valve member 262 to the open position and which, at one end, bears against the upper or top wall 70 of the first housing 58 and which, at the other end, extends through the port 258 in the first motor piston 190 and bears against the upper surface of the valve member 262. The valve member biasing spring 274 is designed so as to be operable to overcome the pressure differential between the first low and high pressure chambers 182 and 186, respectively, and thereby to displace the valve member 262 toward the open position as the first motor piston 190 approaches the position minimizing the volume of the first low pressure chamber 182.

The fluid pressure actuated master motor 42 also includes means responsive to piston movement minimizing the volume of the high pressure chamber 186 for discontinuing communication between the first low and high pressure chambers 182 and 186, respectively, so as to thereby permit the creation of fluid pressure differential between the first low and high pressure chambers 182 and 186, respectively, by the fluid pressure differential creating means 214 and thereby also to effect displacement of the first motor piston 190 in the direction minimizing the volume of the first low pressure chamber 182 and maximizing the volume of the first high pressure chamber 186. While other arrangements can be employed, in the illustrated construction, such means comprises a plurality of studs or posts 290 which extend upwardly from the intermediate partition or wall 74 toward the valve member 262 and through the open valve cage 202 for engagement with the valve member 262 to seat the valve member 262 in the closed position as the first motor piston 190 approaches the position minimizing the volume of the first high pressure chamber 186.

Thus, in operation, the presence of alternating high and low pressures in the conduit system 214 causes (assuming the valve member 262 to be in the closed position) buildup and maintenance of higher pressure in the first relatively high pressure chamber 186 and reduction and maintenance of low pressure in the first low pressure chamber 182. The pressure differential thus created causes displacement of the first movable wall 178, including the first motor piston 190, against the action of the motor piston biasing spring 210, to the position minimizing the volume of the first low pressure chamber 182. As the first motor piston 190 approaches the position minimizing the volume of the first low pressure chamber 182, the valve member biasing spring 274 serves to open the motor piston port 258 by displacing the valve member 262 to the open position and thereby to reduce or minimize the pressure differential and permit displacement of the first movable wall 178 by action of the biasing spring 210 to the position minimizing the volume of the high pressure chamber 186. During such movement, and in the absence of a pressure differential, the valve member 262 remains in the open position under the action of the valve member biasing spring 274.

Upon approach of the first movable wall 178, including the first motor piston 190, to the position minimizing the volume of the first high pressure chamber 186, the studs 290 engage the valve member 262 to cause movement thereof to the closed position. With the motor piston port 258 thus closed, the pressure differential is again created and the first movable wall 178 is again displaced in the opposite direction to commence another cycle of operation.

The second housing 62 includes a peripheral wall 294 together with a top wall 298, a bottom wall 302 and a lower extension 306. The peripheral wall 294, top wall 298 and bottom wall 302 form a second housing compartment 310. Although the second housing 62 is shown in FIG. 1 as being separated from the first housing 58, the second housing 62 can be attached to or integral with the first housing 58.

The oil pumping means 54 is located in the lower extension 306 and comprises a cylindrical space 314 which extends from the second housing compartment 310. Located in the cylindrical space 314 is an oil pumping plunger or element 318 which is reciprocal in the cylindrical space 314 and which in part defines a variable volume oil pumping chamber 322. Seal means 326 is provided between the oil pumping plunger or element 318 and the wall of the cylindrical space 314.

The oil pumping means 54 also includes a valve inlet 330 which is adapted to communicate through a conduit 334 with a source of oil 338 and which includes a one way check valve 342 which affords inflow of oil in response to an increase in volume of the oil pumping chamber 322 and which prevents the outflow of oil.

The oil pumping means 54 also includes a valve outlet 346 which is adapted to communicate through a conduit 350 with the carburetor 142 or other device for feeding a fuel-oil mixture to the crankcase 146 of the two-stroke engine 22. The valve outlet 346 includes a one-way check valve 354 which affords outflow of oil in response to decrease in the volume of the oil pumping chamber 322 and which prevents inflow of oil.

The fluid pressure actuated slave motor 50 is located generally in the second housing compartment 310 and is connected to the oil pumping plunger 318 so as to effect common reciprocation thereof through a given stroke or distance. More particularly, the fluid pressure actuated slave motor 50 is responsive to the pressure differential in the first housing for effecting reciprocation of the first motor piston 190. Still more particularly, the slave motor 50 includes a second movable wall 358 which divides the second housing compartment 310 into a second upper, relatively low pressure variable volume chamber 362 and a second lower, relatively high pressure variable volume chamber 366. The second movable wall 358 includes a central or second motor piston 370 which, at its outer periphery, is connected to a flexible membrane or diaphragm 374 which, at its outer periphery, is secured to the peripheral wall 294 so as to divide the second housing compartment 310 into the before-mentioned second relatively low and high pressure chambers 362 and 366, respectively.

The second motor piston 370 is also preferably integrally connected with the oil pumping plunger or element 318 for common movement. In this last regard, the combined second motor piston 370 and oil pumping plunger 318 includes a central portion 376 which extends from the oil pumping piston 318 toward the second motor piston 370.

The slave motor 50 further includes second means biasing the second movable wall 358 so as to displace the second movable wall 358 in the direction minimizing the volume of the second high pressure chamber 366 and maximizing the volume of the second low pressure chamber 362. In the illustrated construction, such second means comprises a second helical spring 378 which, at one end, bears against the upper or top housing wall 298 and which, at the other end, bears against the second motor piston 370.

The slave motor 50 further includes means for connecting the slave motor 50 with the master motor component 42 for driving the second movable wall 358 by the pressure differential across the first motor piston 190 in the master motor component 42. More particularly, the second low pressure chamber 362 is in communication with the first low pressure chamber 182 by means of a first conduit 382 and the second high pressure chamber 366 is in communication with the first high pressure chamber 186 by means of a second conduit 386.

Accordingly, the relatively high and low pressures present in the first housing 58 will cause the existence of a relatively high pressure in the second high pressure chamber 366 and a relatively low pressure in the second low pressure chamber 362, thereby creating a pressure differential which is of sufficient magnitude, as compared to the biasing action of the second movable wall biasing spring 378, to cause movement of the second movable wall 358 from a position in which the second high pressure chamber 366 is at a minimum volume to a position in which the second low pressure chamber 362 is at a minimum volume.

When the valve member 262 opens to eliminate or reduce the pressure differential between the first low and high pressure chambers 182 and 186, respectively, the pressure differential between the second low and high pressure chambers 362 and 366, respectively, will likewise be eliminated or reduced and thereby permit displacement of the second movable wall 358 by the second biasing spring 378 in the direction minimizing the volume of the second high pressure chamber 366 and maximizing the volume of the second low pressure chamber 362.

The combined fuel and oil pumping device 34 can be mounted to the block of the two-stroke engine 22 so as to afford immediate connection to the engine crankcase 146 and can be connected to remote sources of oil and fuel. Alternately, if desired, the combined fuel pump and oil pump 34 can be located at a remote location more or less adjacent to or with the sources of fuel and oil and a conduit (not shown) can extend between the crankcase 146, or other source of alternating high and low pressures, and the combined fuel and oil pumping device 34.

It is particularly noted that the operation cycle of the combined oil and fuel pumping device 34 is defined by one complete forward and reverse stroke of the master motor piston 190 and that the stroke length of the master motor piston 190 is fixed, whereas the stroke length of the second motor piston 370 can vary depending upon the pressure differential across the master motor piston 190, and the back pressure on the fuel and/or oil being pumped through a discharge line 396 to the engine 22.

More particularly, the spring rate of the master motor biasing spring 210 (and master motor piston size) is desirably selected so that under normal operating conditions, the relatively small pressure variation created during engine idling operation is sufficient, when considered with back pressure in the discharge line 396, to effect full movement of the master motor piston 190 through its stroke length. Greater pressure variations occuring under high speed or load conditions serve to decrease the time period of each operational cycle but do not affect the fixed stroke length.

The spring rate of the slave motor biasing spring 378 (and slave motor piston size) is desirably selected so that, in relation to the stroke length of the master motor piston 190, the second motor piston 370 may or may not travel through a full oil pumping stroke prior to reversal in the direction of travel thereof due to reversal of travel of master motor piston 190. As indicated immediately above, the extent of the stroke of the slave motor piston 370 is determined, not only by the spring rate of the slave biasing spring 378 (and the size of the slave motor piston 370), but also by the pressure differential across the pistons 190 and 370 and the back pressure in the discharge line 396. Accordingly, while the amount of fuel pumped by the fuel pumping piston 110 is constant for each operational cycle and is independent of the pressure differential, the amount of oil pumped varies upon variation in the pressure differential and variation in the downstream back pressure. In this regard, when the pressure differential is relatively small, the stroke of the oil pumping piston 318 will tend to be less than when the pumping pressure differential is greater.

Further in this last regard, when, as described, the source of pressure differential is the variable crankcase pressure in the two stroke engine 22, the pressure differential created across the master motor piston 190 will increase with increasing speed or load. In addition, when the carburetor 142 is employed to regulate supply of fuel mixture to the internal combustion engine 22 as disclosed, the back pressure in the discharge line 396 will be greater at low speeds and loads than at high speeds and loads. The result is, taking into consideration the spring rate of the slave motor biasing spring 378, the size of the slave motor piston 370, the crankcase pressure variation, and the back pressure condition, that the stroke of the oil pumping piston 318 is greater under high speed or load conditions as compared to under low speed or load conditions.

Various of the features of the invention are set forth in the following claims.

We claim:

1. A fluid actuated motor assembly comprising a first fluid actuated motor including a first reciprocating piston driven through a first stroke length by a pressure differential across said first reciprocating piston, and a second fluid pressure actuated motor in communication with said first fluid pressure actuated motor and including a second reciprocating piston driven through a second stroke length by said pressure differential across said first reciprocating piston, and means for varying said second stroke length relative to said first stroke length in response to variation in the magnitude of said pressure differential across said first piston.

2. An internal combustion engine including means for generating alternating high and low pressure conditions, a first fluid pressure actuated motor including a first reciprocating piston driven through a first stroke length by a pressure differential across said first reciprocating piston in response to respective application to opposite sides of said first piston of the said alternating high and low pressure conditions, and a second fluid pressure actuated motor in communication with said first fluid pressure actuated motor and including a second reciprocating piston driven through a second stroke length by said pressure differential across said first reciprocating piston, and means for varying said second stroke length relative to said first stroke length in response to variation in the magnitude of the pressure differential across said first piston.

3. A marine propulsion device comprising an internal combustion engine including means for generating alternating high and low pressure conditions, a first fluid pressure actuated motor including a first reciprocating piston driven through a first stroke length by a pressure differential across said first reciprocating piston in response to respective application to opposite sides of said first piston of the said alternating high and low pressure conditions, and a second fluid pressure actuated motor in communication with said first fluid pressure actuated motor and including a second reciprocating piston driven through a second stroke length by said pressure differential across said first reciprocating piston, and means for varying said second stroke length relative to said first stroke length in response to variation in the magnitude of the pressure differential across said first piston.

4. A combined fuel and oil pump comprising a first fluid pressure actuated motor including a first reciprocating piston driven through a first stroke length by a pressure differential across said first piston, means for pumping fuel in response to reciprocal movement of said first piston, a second fluid pressure actuated motor in communication with said first fluid pressure actuated motor and including a second reciprocating piston driven through a second stroke length by said pressure differential across said first piston, means for varying said second stroke length relative to said first stroke length in response to variation in the magnitude of said pressure differential across said first piston, and means for pumping oil in response to reciprocal movement of said second reciprocating piston.

5. A combined fuel and oil pump in accordance with claim 4 wherein said means for varying said second stroke length comprises a biasing spring.

6. A fluid pressure actuated motor comprising a first housing, a first piston movable reciprocally in said first housing through a first stroke length and dividing said first housing into a first relatively low pressure chamber and a first relatively high pressure chamber, first means for biasing said first piston so as to displace said first piston in the direction minimizing the volume of said first high pressure chamber and maximizing the volume of said first low pressure chamber, means for creating a fluid pressure differential between said first high and first low pressure chambers so as to displace said first piston in the direction minimizing the volume of said first low pressure chamber and maximizing the volume of said first high pressure chamber, and means for reducing the pressure differential between said first high and first low pressure chambers so as to thereby permit displacement of said first piston by said first biasing means in the direction minimizing the volume of said first high pressure chamber and maximizing the volume of said first low pressure chamber, a second housing, a second piston movable reciprocally in said second housing through a second stroke length and dividing said second housing into a second relatively low pressure chamber in communication with said first low pressure chamber, a second relatively high pressure chamber in communication with said first high pressure chamber, and means for varying said second stroke length relative to said first stroke length in response to variation in the magnitude of the pressure differential across said first piston, said stroke length variation means comprising means for biasing said second piston so as to displace said second piston in the direction minimizing the volume of said second high pressure chamber and maximizing the volume of said second low pressure chamber.

7. A fluid pressure actuated motor in accordance with claim 6 and further including means for pumping fuel in response to reciprocal movement of said first piston, and means for pumping oil in response to reciprocal movement of said second piston.

8. A fluid pressure actuated motor in accordance with claim 6 wherein said first housing and said second housing are integrally connected.

9. A fluid pressure actuated motor in accordance with claim 6 wherein said first housing and said second housing are detached and further including a first conduit connecting said first low pressure chamber to said second low pressure chamber and a second conduit connecting said first high pressure chamber to said second high pressure chamber.

* * * * *